US010654044B2

(12) United States Patent
Aitken

(10) Patent No.: US 10,654,044 B2
(45) Date of Patent: May 19, 2020

(54) CYCLONIC SHEAR PLATES AND METHOD

(71) Applicant: Paul J. Aitken, Burleson, TX (US)

(72) Inventor: Paul J. Aitken, Burleson, TX (US)

( * ) Notice: Subject to any disclaimer, the term of this patent is extended or adjusted under 35 U.S.C. 154(b) by 338 days.

(21) Appl. No.: 15/267,120

(22) Filed: Sep. 15, 2016

(65) Prior Publication Data

US 2017/0072402 A1 Mar. 16, 2017

Related U.S. Application Data

(60) Provisional application No. 62/219,535, filed on Sep. 16, 2015.

(51) Int. Cl.

| | |
|---|---|
| ***B02C 7/12*** | (2006.01) |
| ***B01F 7/00*** | (2006.01) |
| ***D21D 1/30*** | (2006.01) |
| ***B02C 7/06*** | (2006.01) |
| ***B02C 7/02*** | (2006.01) |
| ***B02C 7/04*** | (2006.01) |

(52) U.S. Cl.

CPC ..... *B02C 7/12* (2013.01); *B01F 7/00766* (2013.01); *B01F 7/00783* (2013.01); *B02C 7/02* (2013.01); *B02C 7/04* (2013.01); *B02C 7/06* (2013.01); *D21D 1/30* (2013.01); *D21D 1/303* (2013.01); *D21D 1/306* (2013.01)

(58) Field of Classification Search

CPC .... B02C 7/12; B02C 7/02; B02C 7/06; B02C 7/04; D21D 1/30; D21D 1/303; D21D 1/306; B01F 7/00766; B01F 7/00783

USPC ..... 241/30, 298, 261.3, 261.2

See application file for complete search history.

(56) References Cited

U.S. PATENT DOCUMENTS

| | | | | |
|---|---|---|---|---|
| 22,588 A * | 1/1859 | Stanford | B02C 7/12 241/296 |
| 1,948,384 A | 2/1934 | Lawrence | |
| 2,335,002 A | 11/1943 | Eppenbach et al. | |
| 3,224,689 A | 12/1965 | Behrens et al. | |
| 3,387,796 A * | 6/1968 | Blair | B02C 7/08 241/259 |

(Continued)

FOREIGN PATENT DOCUMENTS

| | | |
|---|---|---|
| EP | 0135697 | 4/1985 |
| WO | 200071256 | 11/2000 |

*Primary Examiner* — Adam J Eiseman
*Assistant Examiner* — Mohammed S. Alawadi
(74) *Attorney, Agent, or Firm* — DanBrown Law Office; Daniel R. Brown

(57) ABSTRACT

A cyclonic comminuting device includes a set of shearing plates that is adaptable to any colloid mill for improved efficiency and effectiveness in the production of all commodities including, but not limited to, asphalt or bitumen modification, tar, plastics, polymers, cosmetic processing and foods processing. The set of shearing plates includes a set of concave cutting edges. The set of concave cutting edges is applied to radial teeth of a rotor plate and/or a stator plate of the set of shearing plates forming a cyclonic flow pattern of a commodity as the commodity is passed through the comminuting device. The resulting turbulence created by the intersecting concave cutting edges on the rotor plate and the stator plate increases the effective hydraulic shear generated by the rotor plate and the stator plate resulting in greater particle pulverization and resulting in higher quality emulsions with reduced cost of materials required for production.

18 Claims, 10 Drawing Sheets

(56) References Cited

U.S. PATENT DOCUMENTS

| | | | | |
|---|---|---|---|---|
| 8,342,437 | B2 * | 1/2013 | Antensteiner | D21D 1/30 241/261.3 |
| 8,915,457 | B2 * | 12/2014 | Dodd | B02C 7/00 241/24.19 |
| 2008/0061004 | A1 * | 3/2008 | Balvanz | A23K 10/38 210/710 |
| 2009/0252845 | A1 * | 10/2009 | Southwick | A23L 3/00 426/330 |
| 2014/0217209 | A1 * | 8/2014 | Priebe | B02C 19/08 241/30 |
| 2016/0138220 | A1 * | 5/2016 | Gingras | D21D 1/30 241/298 |

* cited by examiner

CYCLONIC SHEAR PLATES AND METHOD

CROSS-REFERENCE TO RELATED APPLICATION

This application claims priority to U.S. Provisional Application No. 62/219,535, filed Sep. 16, 2015. This patent application is incorporated herein by reference in its entirety to provide continuity of disclosure.

FIELD OF THE INVENTION

The present invention generally relates to systems and methods for emulsifying products. In particular, the present invention relates to a set of shear plates having a set of concave cutting edges for use on a colloid mill.

BACKGROUND OF THE INVENTION

Industrial-grade mixing devices are generally divided into classes based upon their ability to mix fluids. Mixing is the process of reducing the size of particles or inhomogeneous species within the fluid. One metric for measuring the degree or "thoroughness" of mixing is the energy density per unit volume that a mixing device generates to disrupt the fluid particles. The classes are distinguished based on delivered energy densities. Three classes of industrial mixers have sufficient energy density to consistently produce mixtures or emulsions with particle sizes in a range from approximately 0 to approximately 50 microns.

Homogenization valve systems are typically classified as high energy devices. Fluid to be processed is pumped under high pressure through a narrow gap valve into a lower pressure environment. The pressure gradients across the valve and the resulting turbulence and cavitation act to break-up any particles in the fluid. These valve systems are most commonly used in milk homogenization and can yield average particle sizes in a range from approximately 0 to 1 micron.

In contrast, high shear mixer systems are classified as low energy devices. These systems typically utilize paddles or fluid rotors that turn at high speed in a reservoir of fluid to be processed, which, in many of the more common applications, is a food product. These systems are usually used when the acceptable average of particle sizes is greater than approximately 20 microns in the processed fluid.

Between high shear mixers and homogenization valve systems, in terms of the mixing energy density delivered to the fluid, are colloid mills, which are classified as intermediate energy devices. A colloid mill is a machine that is used to reduce the particle size of a solid in suspension in a liquid, or to reduce the droplet size of a liquid suspended in another liquid. This reduction is accomplished by applying high levels of hydraulic and mechanical shear via shear plates to the process liquid, thereby increasing the stability of suspensions and emulsions. Typically, colloid mills utilize a rotor shear plate and stator shear plate or cylinder. Many colloid mills with proper adjustment achieve average particle sizes of approximately 1 to approximately 25 microns in the processed fluid. These capabilities render colloid mills appropriate for a variety of applications including colloid and oil/water-based emulsion processing such as that required for everything from cosmetics, mayonnaise, or silicone/silver amalgam formation, to road and roofing-tar mixing.

However, colloid mills suffer from several problems, including low throughput and long cycle times. The prior art has attempted to solve these problems by making only minor variations with limited success.

Therefore, there is a need in the art to improve the process of modifying and emulsifying products including asphalt products, also known as bitumen products. Specifically, there is a need for a set of cyclonic shearing plates that modify and emulsify asphalt more efficiently than any shearing system of the prior art.

SUMMARY

A cyclonic comminuting device includes a set of shearing plates that is adaptable to any colloid mill for improved efficiency and effectiveness in the production of all commodities including, but not limited to, asphalt or bitumen modification, tar, plastics, polymers, cosmetic processing and foods processing.

The set of shearing plates includes a set of concave cutting edges. The set of concave cutting edges is applied to radial teeth of a rotor plate and/or a stator plate of the set of shearing plates forming a cyclonic flow pattern of a commodity as the commodity is passed through the comminuting device. The resulting turbulence created by the intersecting concave cutting edges on the rotor plate and the stator plate increases the effective hydraulic shear generated by the rotor plate and the stator plate resulting in greater particle pulverization and resulting in higher quality emulsions with reduced cost of materials required for production.

The disclosed embodiments increase the efficiency of the emulsification process with the improved mechanical shear action created by the curved or concave cutting. The ultra-sharp intersecting edges will increase the effectiveness and efficiency of the rotor plate and the stator plate.

BRIEF DESCRIPTION OF THE DRAWINGS

In the detailed description presented below, reference will be made to the following drawings.

DETAILED DESCRIPTION

Figure 1A:
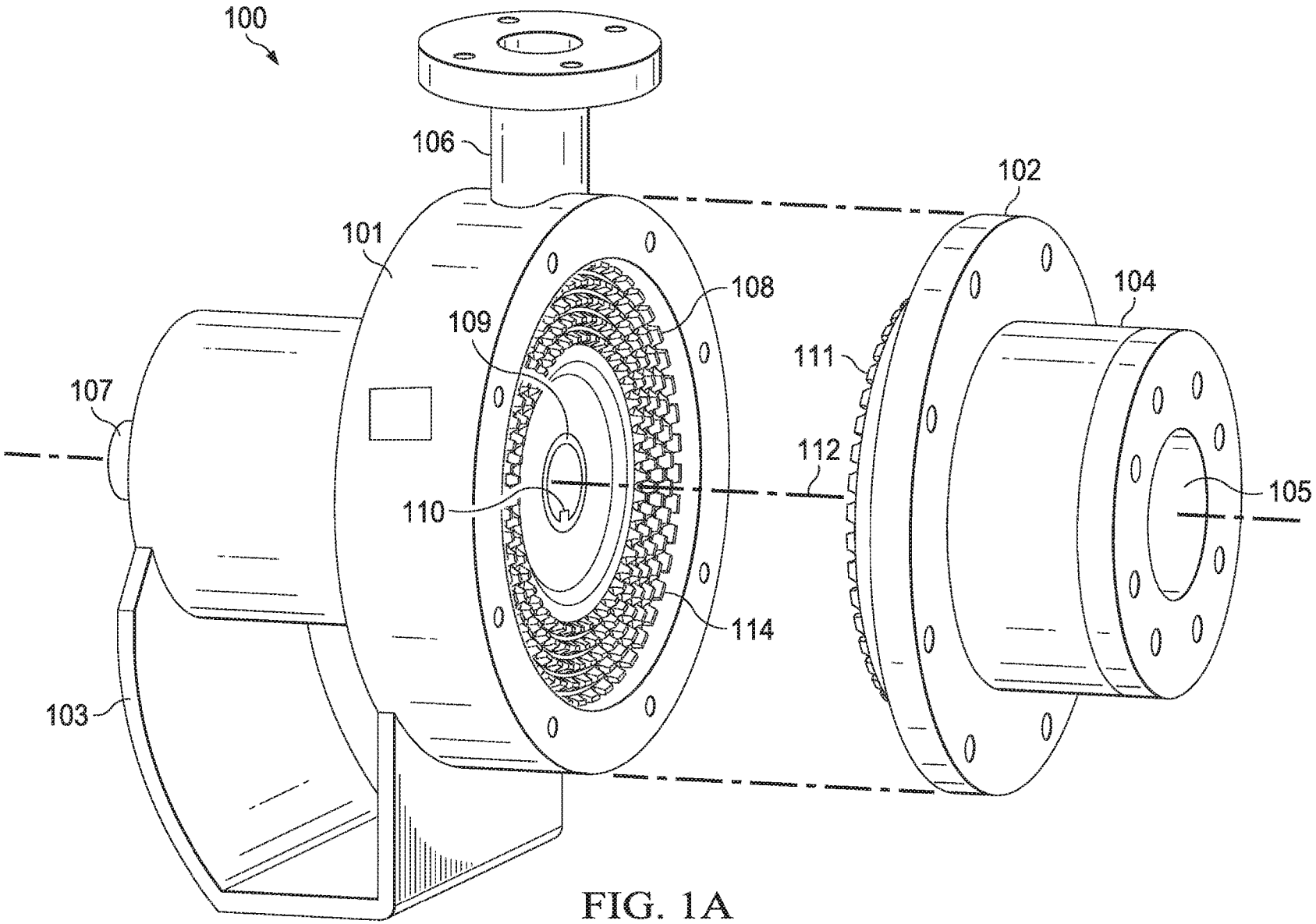
FIG. 1A is an exploded perspective view of a colloid mill and a set of shear plates of a preferred embodiment.
Figure 1B:
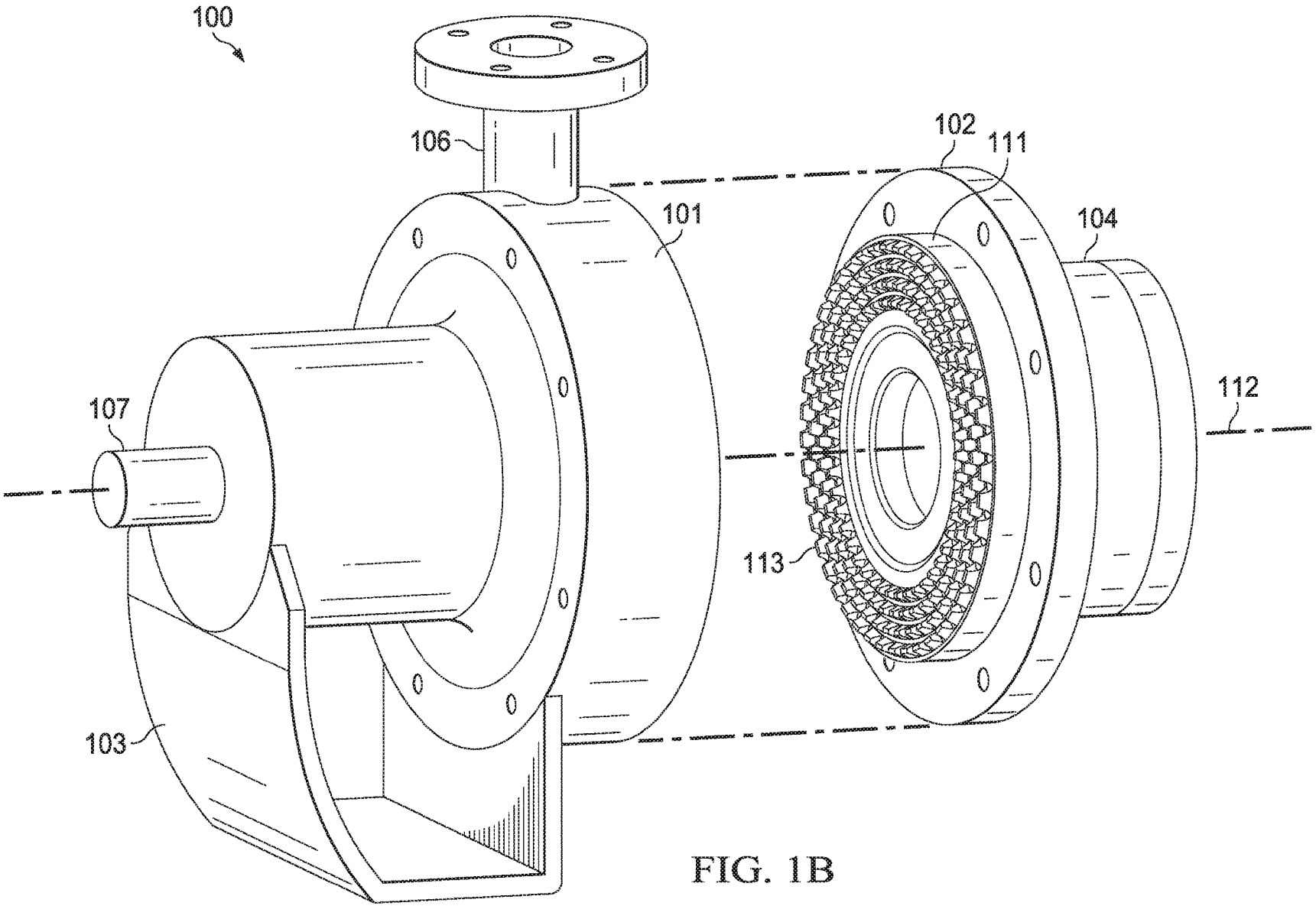
FIG. 1B is an exploded perspective view of a colloid mill and a set of shear plates of a preferred embodiment.

Referring to FIGS. 1A and 1B, colloid mill 100 includes housing 101 and endcap 102 connected to rotor housing 101.

Base 103 is attached to housing 101. Housing 101 includes product outlet 106. Shaft 107 is connected to rotor plate 108 through housing 101. Rotor plate 108 includes hub 109 and set of rotor teeth 114. Fastener 110 connects rotor plate 108 to shaft 107. Endcap 102 includes intake 104. Intake 104 includes hole 105 to receive supply components. Any number intake holes or ports may be employed. Stator plate 111 is attached to endcap 102. Stator plate 111 includes set of stator teeth 113.

In a preferred embodiment, a motor is connected to shaft 107 to rotate shaft 107 and thereby rotor plate 108 about axis 112. Supply components enter through hole 105 of intake 104 and are processed between rotor plate 108 and stator plate 111. The rotation of rotor plate 108 about axis 112 generates shearing forces to emulsify and process the supply components entering through hole 105 of intake 104. The resulting processed components exit through outlet 106.

Any colloid mill known in the art may be employed as colloid mill 100. In one embodiment, stator plate 111 is optionally stationary with respect to rotor plate 108. In other embodiments, stator plate 111 is rotatably mounted to endcap 102 or a similar housing structure via a shaft. In these embodiments, a motor is connected to this shaft to rotate stator plate 111. In other embodiments, stator plate 111 is driven by a fluid between rotor plate 108 and stator plate 111.

Figure 2:
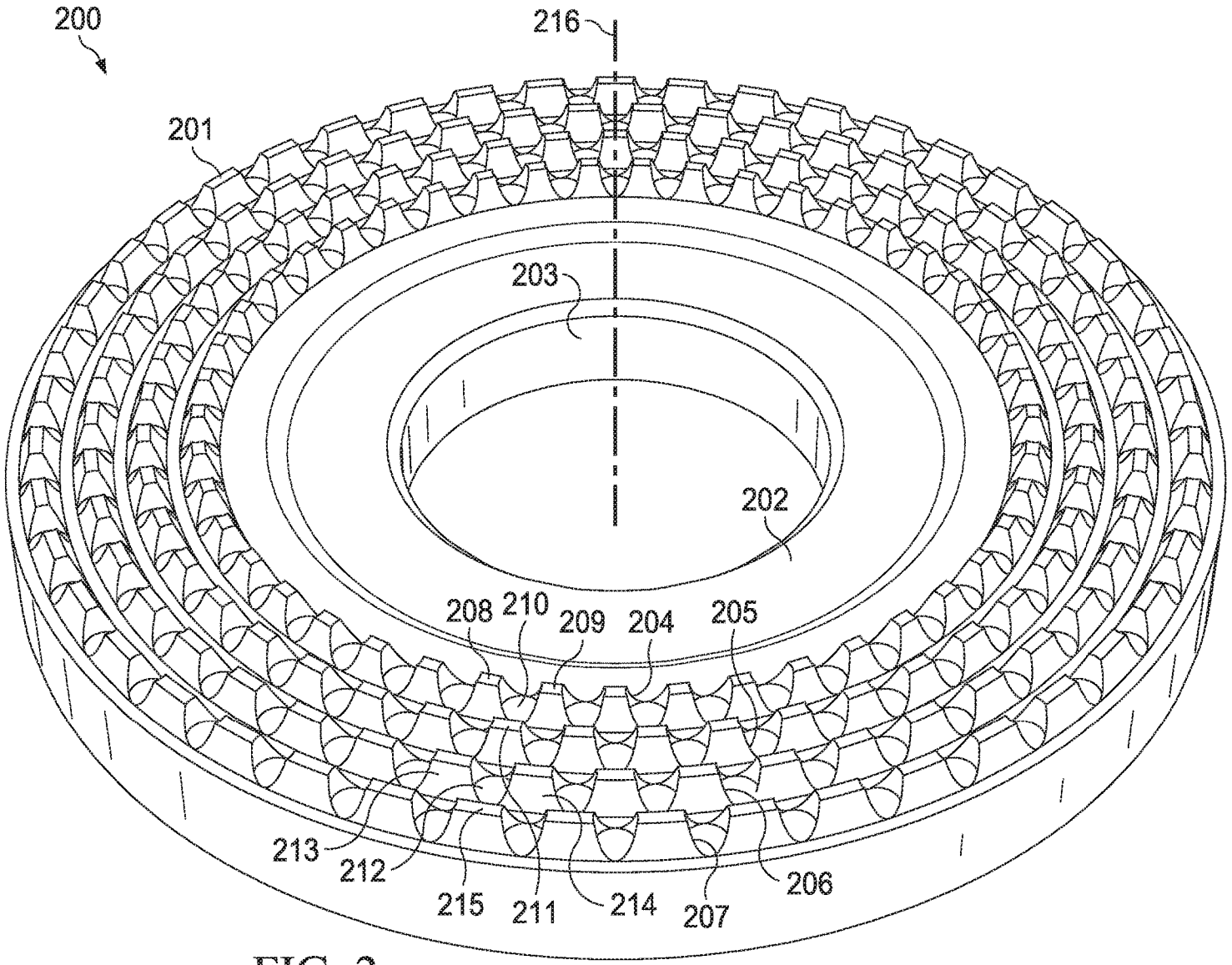
FIG. 2 is a perspective view of a stator plate of a preferred embodiment.

Referring to FIG. 2, stator plate 111 will be further described as stator plate 200. Stator plate 200 includes a set of stator teeth 201 and hub 202 integrally formed with set of stator teeth 201. Set of stator teeth 201 surrounds hub 202. Hub 202 includes hole 203. Set of stator teeth 201 is arranged in a set of concentrically aligned rings 204, 205, 206, and 207, each of which has a different radius from center axis 216. Each tooth of rings 204, 205, 206, and 207 is misaligned with respect to an adjacent tooth of a different ring. For example, tooth 208 and 209 of ring 204 are separated by void 210. Tooth 211 of ring 205 is generally aligned with void 210. Void 212 separates tooth 213 and tooth 214 of ring 206. Tooth 215 of ring 207 is generally aligned with void 212 of ring 206.

In a preferred embodiment, set of stator teeth 201 includes any number of singular teeth and any number of rings of teeth.

In a preferred embodiment, each of rings 204, 205, 206, and 207 is generally circular in shape. Other shapes may be employed.

In a preferred embodiment, each tooth of the set of teeth 201 includes a concave or a curved cutting edge as will be further described below.

In a preferred embodiment, stator plate 200 is made of a durable material such as a titanium, a stainless steel, or an alloy thereof. Other suitable durable materials known in the art may also be employed.

In one embodiment stator plate 200 is machined from a single piece of material. In another embodiment, stator plate 200 is cast in a mold from a molten material. Other suitable manufacturing means known in the art may be employed.

Figure 3:
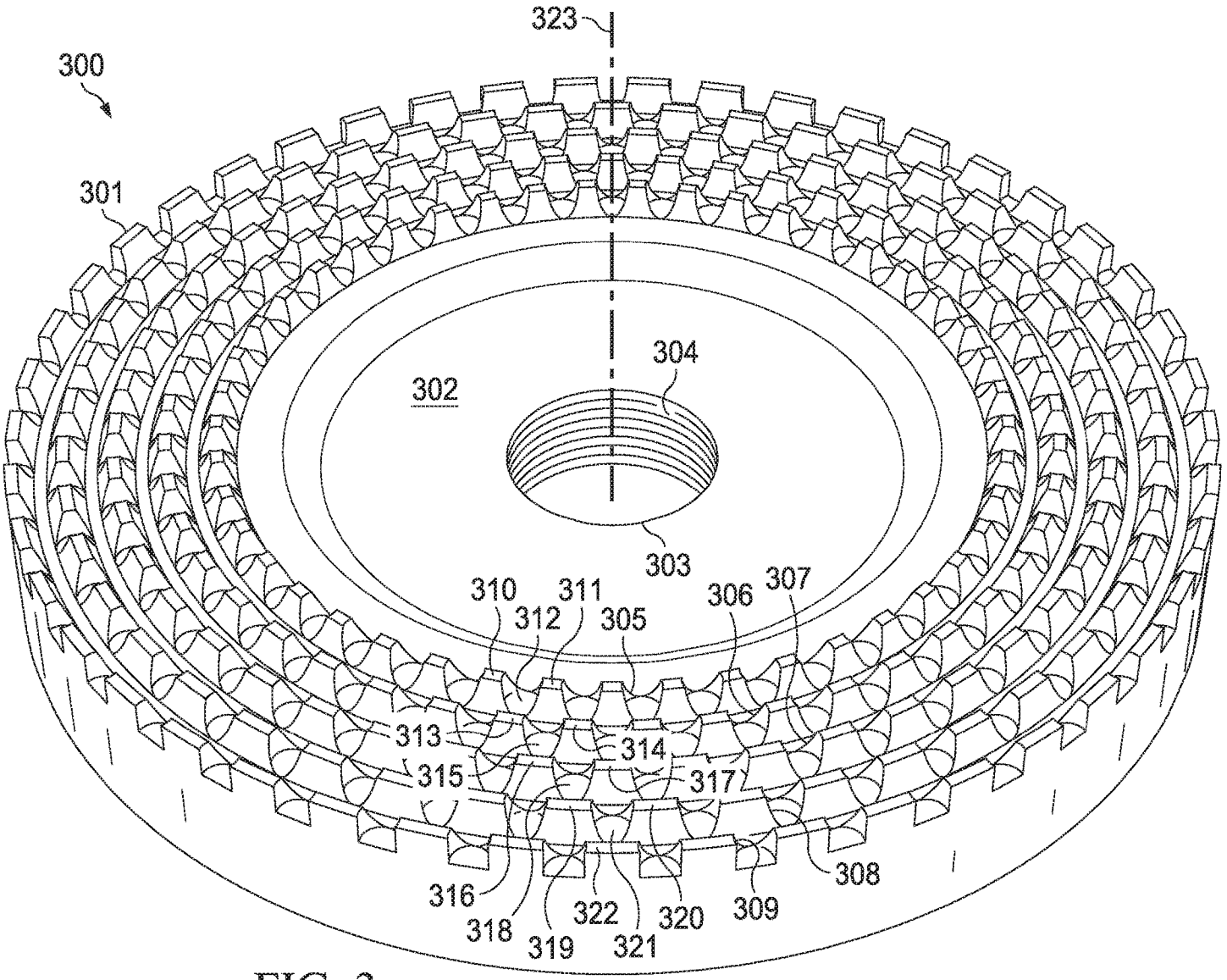
FIG. 3 is a perspective view of a rotor plate of a preferred embodiment.

Referring to FIG. 3, rotor plate 108 will be further described as rotor plate 300. Rotor plate 300 includes set of rotor teeth 301 integrally formed with hub 302. Hub 302 includes hole 303 concentrically aligned with set of rotor teeth 301. Hole 303 includes set of threads 304. Any type of mounting means known in the art may be employed, including but not limited to, a tapered shank or a keyed alignment. Set of rotor teeth 301 is arranged in a set of concentrically aligned rings 305, 306, 307, 308, and 309, each of which has a different radius from center axis 323. Each tooth in each of rings 305, 306, 307, 308, and 309, is misaligned with respect to a tooth of an adjacent ring. For example, tooth 310 and tooth 311 of ring 305 are separated by void 312. Tooth 313 of ring 306 is generally aligned with void 312. Tooth 313 and tooth 314 are separated by void 315 of ring 306. Tooth 316 of ring 307 is generally aligned with void 315. Tooth 316 and tooth 317 of ring 307 are separated by void 318. Tooth 319 of ring 308 is generally aligned with void 318. Tooth 319 and tooth 320 of ring 308 are separated by void 321. Tooth 322 of ring 309 is aligned with void 321 of ring 308.

In a preferred embodiment, each of rings 305, 306, 307, 308, and 309 is generally circular in shape. Other shapes may be employed.

In a preferred embodiment, set of rotor teeth 301 includes any number of singular teeth and any number of rings of teeth.

In a preferred embodiment, each tooth of set of rotor teeth 301 has a concave or a curved cutting edge as will be further described below.

In a preferred embodiment, rotor plate 300 is made of a durable material such as titanium, a stainless steel, or an alloy thereof. Other suitable materials known in the art may be employed.

In one embodiment, rotor plate 300 is machined from a single piece of material. In another embodiment, rotor plate 300 is cast in a mold from a molten material. Other suitable manufacturing means known in the art may be employed.

Figure 4:
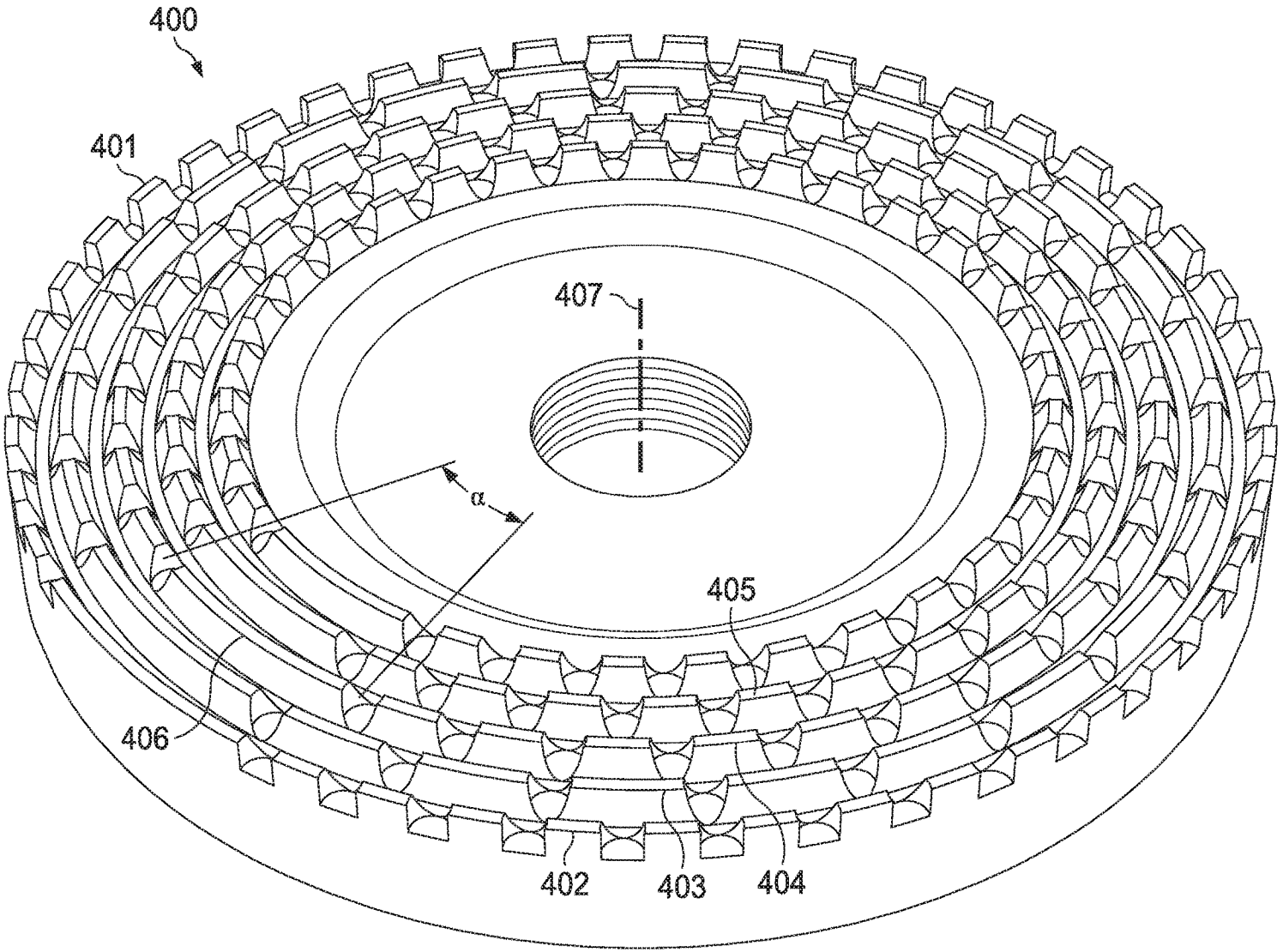
FIG. 4 is a detail view of a set of teeth of a rotor plate of a preferred embodiment.

Referring to FIG. 4, each of the set of stator teeth 201 and set of rotor teeth 301 has any sized tooth as desired for any desired application. By way of example, rotor plate 400 includes set of rotor teeth 401, which includes teeth 402, 403, 404, 405, and 406. As can be seen, the arc length of tooth 402 is approximately half the arc length of tooth 403, the arc length of tooth 404 is less than the arc length of tooth 403, and the arc length of tooth 405 is approximately less than the arc length of tooth 404. For example, the arc length of tooth 406 extends about axis 407 and spans an angle $\alpha$.

In a preferred embodiment, angle $\alpha$ is approximately 30°. Other angles may be employed. Other arc lengths of each of teeth 402, 403, 404, 405, and 406 may be employed to suit any desired application.

Figure 5A:
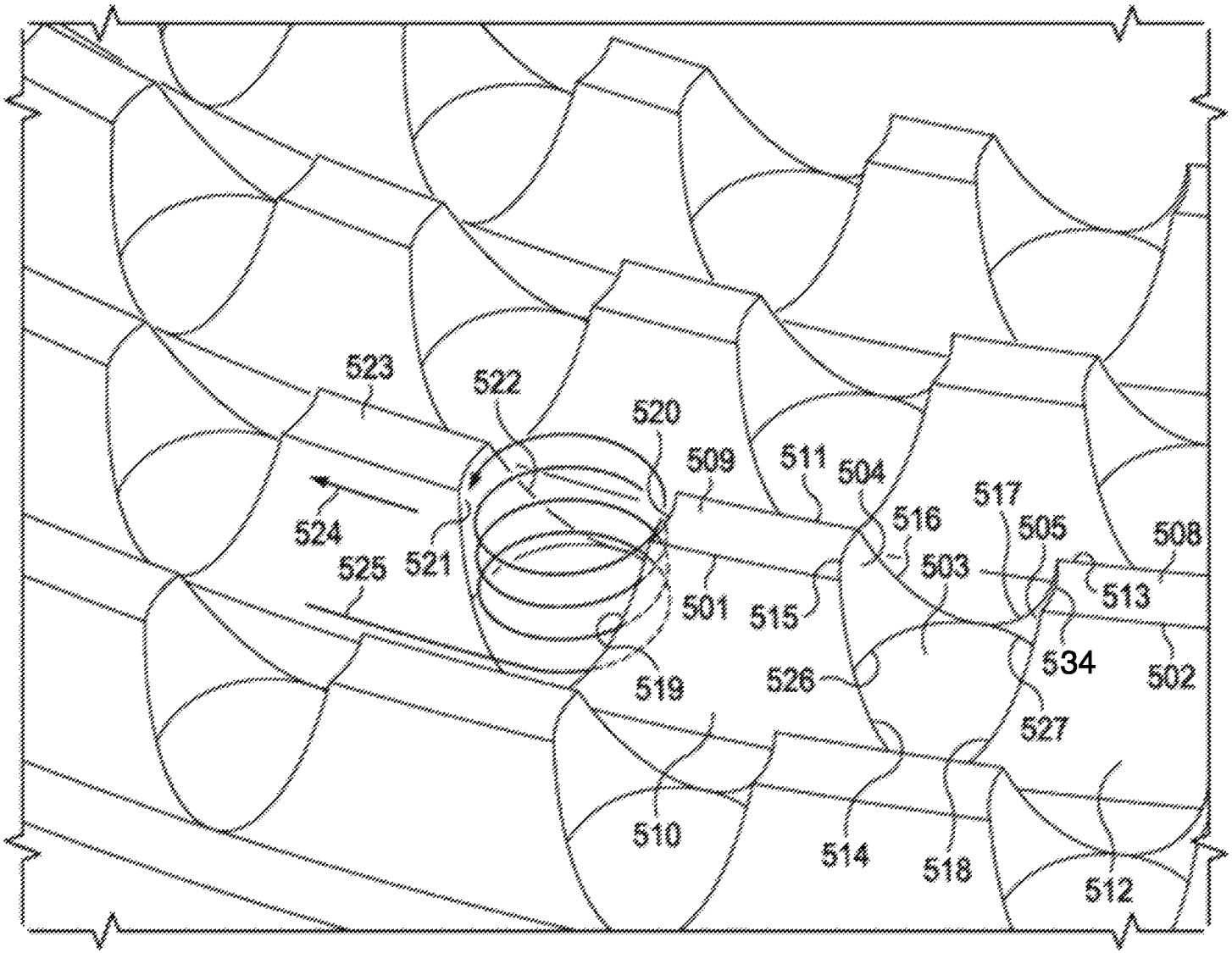
FIG. 5A is a detail view of a set of teeth of a stator plate of a preferred embodiment.

Referring to FIG. 5A, each tooth of stator plate 200 and rotor plate 300 has a concave cutting edge or a curved cutting edge as will now be further described. Tooth 501 and tooth 502 are separated by void 503. Void 503 is defined by side 504 of tooth 501 and side 505 of tooth 502. Tooth 501 includes side 510 and side 511 opposite side 510. Surface 509 is adjacent to side 510 and side 511. Tooth 502 includes side 512 and side 513 opposite side 512. Surface 508 is adjacent to side 512 and side 513. Side 504 includes edges 514, 516, and border 526. Surface 509 includes edge 515. Side 505 includes edges 517 and 518, and border 527. Surface 508 includes edge 519. Edge 514 and edge 518 are each generally curved in shape. Edge 516 and edge 517 are generally curved in shape. Edge 515 and edge 534 are generally curved in shape. Edges 514 and 519 form a generally parabolic curve. Edge 516 and 517 form a generally parabolic curve. Each of sides 504 and 505 is curved in shape forming a generally concave surface.

In a preferred embodiment, sides 504 and 505 and void 503 generate shear forces when a fluid engages with sides 504 and 505 when in use. For example, as teeth 501, 502, and 523 move in direction 524, a fluid will generally follow path 525. Path 525 will engage with edge 519 of side 520 of tooth 501. The curved surface of side 520 will redirect the fluid along path 525 to further engage with edge 522 and side 521 of tooth 523. As can be seen, sides 520 and 521 generate a generally cyclone-like shape of fluid path 525. As a result, the cyclonic shearing forces emulsify and process particles more efficiently than that found in the prior art.

Figure 5B:
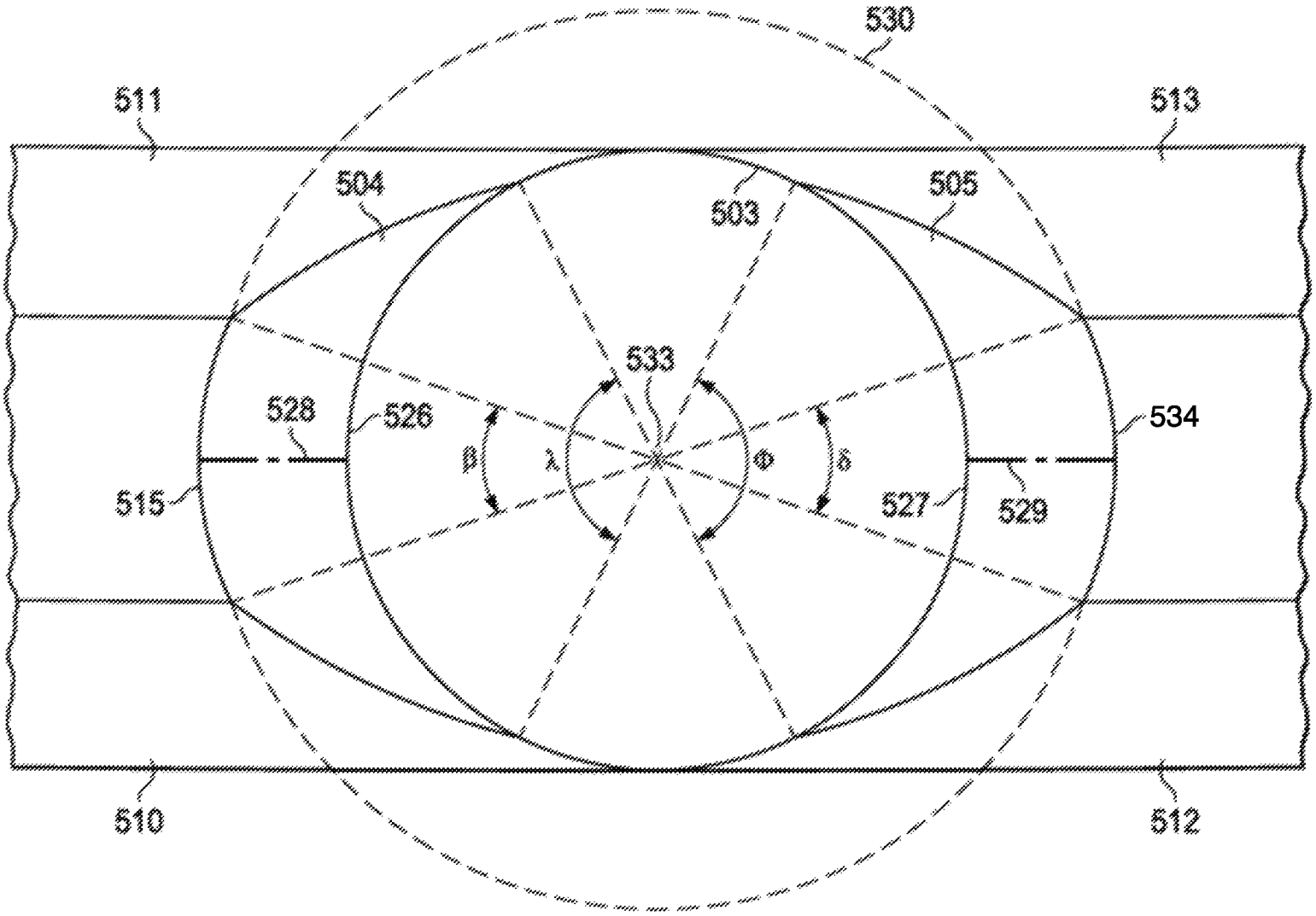
FIG. 5B is a top view of a set of teeth of a stator plate of a preferred embodiment.

Referring to FIG. 5B, void 503 includes center 533. Side 504 includes center line 528 and border 526. Border 526 is preferably a circular arc of void 503 about center 533 having arc length that spans angle λ. Side 505 includes center line 529 and border 527. Border 527 is preferably a circular arc of void 503 about center 533 having arc length that spans angle ϕ. Edge 515 spans a circular arc having arc length that spans angle β of circle 530. Edge 519 spans a circular arc having an arc length that spans angle γ of circle 530.

In a preferred embodiment, void 503 and circle 530 are concentrically aligned.

In a preferred embodiment, angle β is approximately 45°. Other angles may be employed.

In a preferred embodiment, angle γ is approximately 45°. Other angles may be employed.

In a preferred embodiment, angle λ approximately 135°. Other angles may be employed.

In a preferred embodiment, angle ϕ is approximately 135°. Other angles may be employed.

Figure 5C:
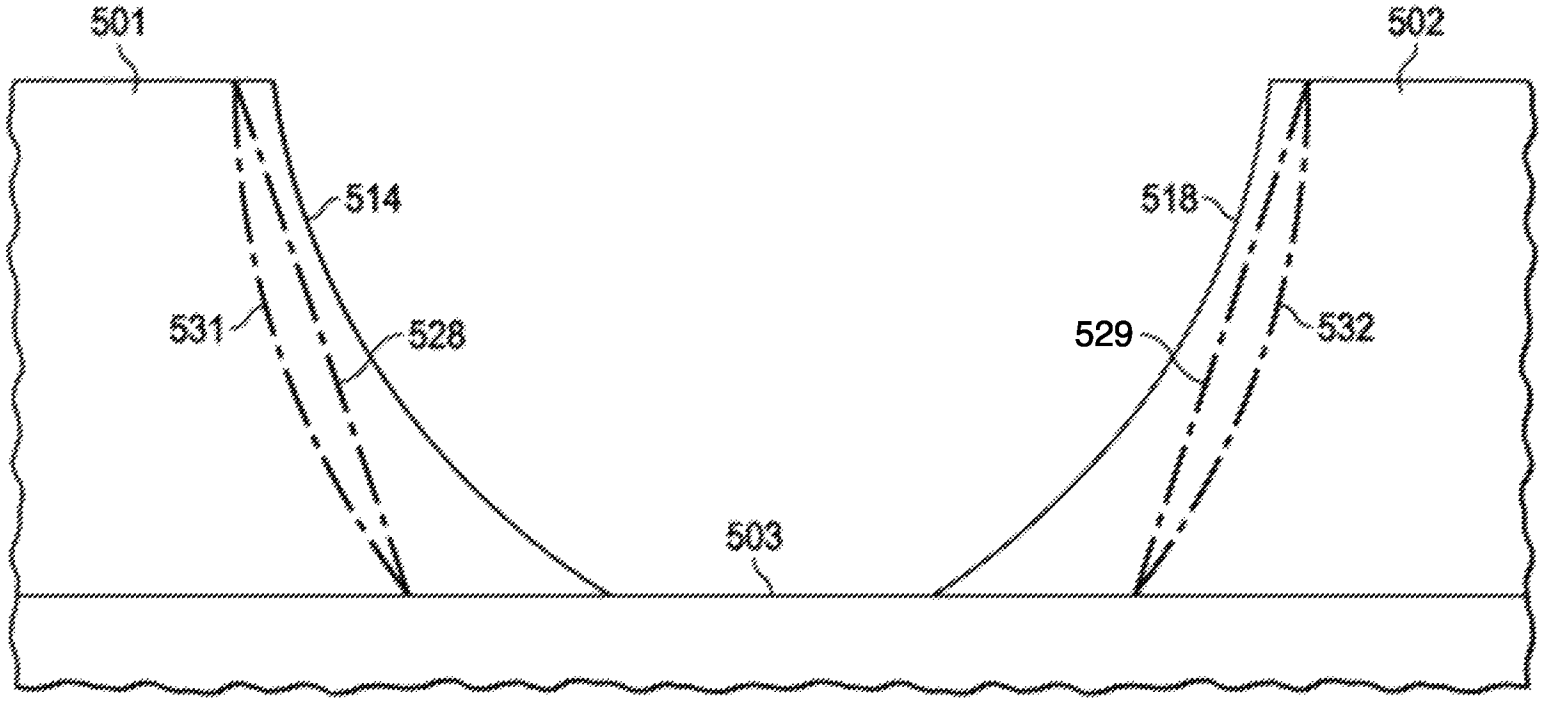
FIG. 5C is a side view of a set of teeth of a stator plate of a preferred embodiment.

Referring to FIG. 5C, edges 514 and 518 form a generally parabolic curve. In a preferred embodiment, center lines 528 and 529 of sides 504 and 505 respectively define a generally frustoconical shape. In another embodiment, sides 504 and 505 have center lines 531 and 532, respectively. In this embodiment, center lines 531 and 532 form a generally parabolic curve. In this embodiment, center line 531 and 532 define a generally paraboloidic surface. In other embodiments, other shapes including a cylinder may be employed.

Test 1

Figure 6:
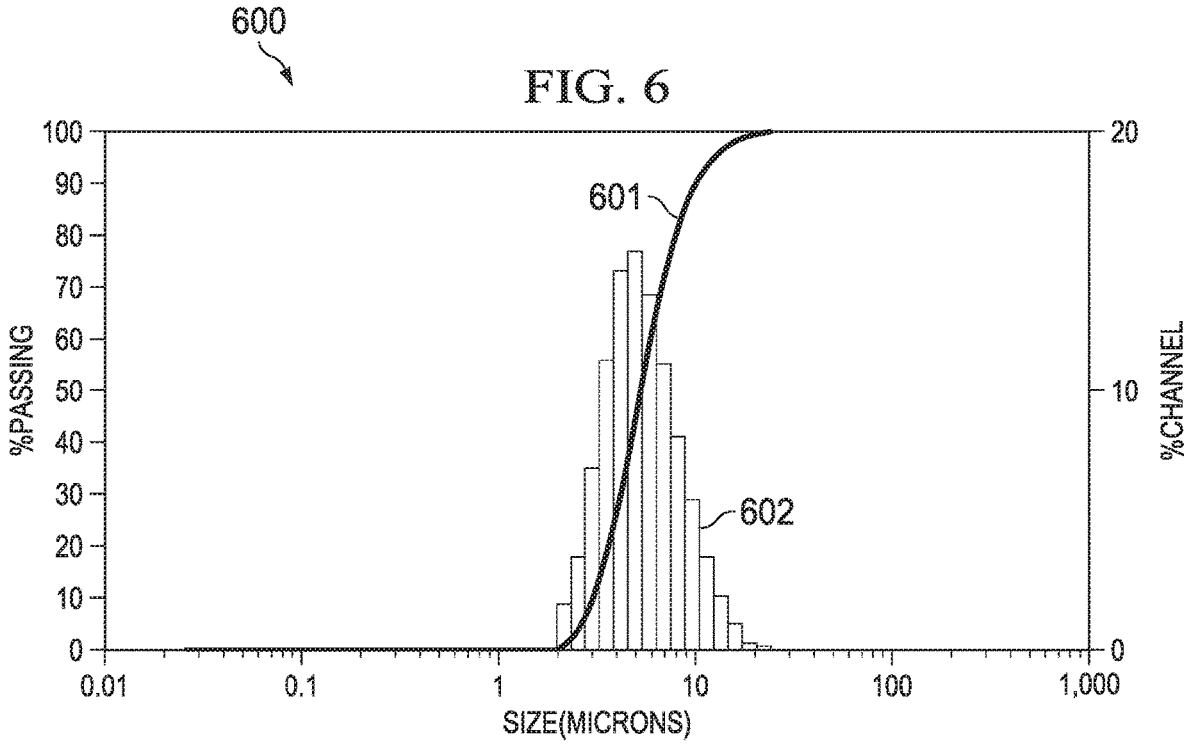
FIG. 6 is a graph of particle size distribution of a product processed using a set of shear plates of a preferred embodiment.

Referring to FIG. 6, graph 600 shows the results of a first test of the disclosed embodiments in a colloid mill processing an asphalt product. Graph 600 includes curve 601 and bar graph 602. Curve 601 is the passing percentage of the particles. The volume percent-in-channel (% Chan) values are read as volume percent between the particle size on the same line and the line below. The passing percentage is the "passing grade" percent of particles that are acceptable/passable in the resulting product. Bar graph 602 is the channel percentage illustrating the distribution of particle sizes in the asphalt product in microns. The data for graph 600 is displayed in Tables 1 and 2 below.

TABLE 1

| Test 1 | | |
|---|---|---|
| Size (μm) | % Chan | % Passing |
| 704.0 | 0.00 | 100.00 |
| 592.0 | 0.00 | 100.00 |
| 497.8 | 0.00 | 100.00 |
| 418.6 | 0.00 | 100.00 |
| 352.0 | 0.00 | 100.00 |
| 296.0 | 0.00 | 100.00 |
| 248.9 | 0.00 | 100.00 |
| 209.3 | 0.00 | 100.00 |
| 176.0 | 0.00 | 100.00 |
| 148.0 | 0.00 | 100.00 |
| 124.5 | 0.00 | 100.00 |
| 104.7 | 0.00 | 100.00 |
| 88.00 | 0.00 | 100.00 |
| 74.00 | 0.00 | 100.00 |
| 62.23 | 0.00 | 100.00 |
| 52.33 | 0.00 | 100.00 |

TABLE 1-continued

| Test 1 | | |
|---|---|---|
| Size (μm) | % Chan | % Passing |
| 44.00 | 0.00 | 100.00 |
| 37.00 | 0.00 | 100.00 |
| 31.11 | 0.00 | 100.00 |
| 26.16 | 0.09 | 100.00 |
| 22.00 | 0.35 | 99.91 |
| 18.50 | 0.97 | 99.56 |
| 15.56 | 2.09 | 98.59 |
| 13.08 | 3.70 | 96.50 |
| 11.00 | 5.77 | 92.80 |
| 9.25 | 8.29 | 87.03 |
| 7.78 | 11.14 | 78.74 |
| 6.54 | 13.83 | 67.60 |
| 5.50 | 15.42 | 53.77 |
| 4.62 | 14.62 | 38.35 |
| 3.89 | 11.30 | 23.73 |
| 3.27 | 7.02 | 12.43 |
| 2.750 | 3.64 | 5.41 |
| 2.312 | 1.77 | 1.77 |

TABLE 2

| Test 1 (continued) | | |
|---|---|---|
| Size (μm) | % Chan | % Pass |
| 1.945 | 0.00 | 0.00 |
| 1.635 | 0.00 | 0.00 |
| 1.375 | 0.00 | 0.00 |
| 1.156 | 0.00 | 0.00 |
| 0.972 | 0.00 | 0.00 |
| 0.818 | 0.00 | 0.00 |
| 0.688 | 0.00 | 0.00 |
| 0.578 | 0.00 | 0.00 |
| 0.486 | 0.00 | 0.00 |
| 0.409 | 0.00 | 0.00 |
| 0.344 | 0.00 | 0.00 |
| 0.2890 | 0.00 | 0.00 |
| 0.2430 | 0.00 | 0.00 |
| 0.2040 | 0.00 | 0.00 |
| 0.1720 | 0.00 | 0.00 |
| 0.1450 | 0.00 | 0.00 |
| 0.1220 | 0.00 | 0.00 |
| 0.1020 | 0.00 | 0.00 |
| 0.0860 | 0.00 | 0.00 |
| 0.0720 | 0.00 | 0.00 |
| 0.0610 | 0.00 | 0.00 |
| 0.0510 | 0.00 | 0.00 |
| 0.0430 | 0.00 | 0.00 |
| 0.0360 | 0.00 | 0.00 |
| 0.0300 | 0.00 | 0.00 |
| 0.02550 | 0.00 | 0.00 |

Test 2

Figure 7:
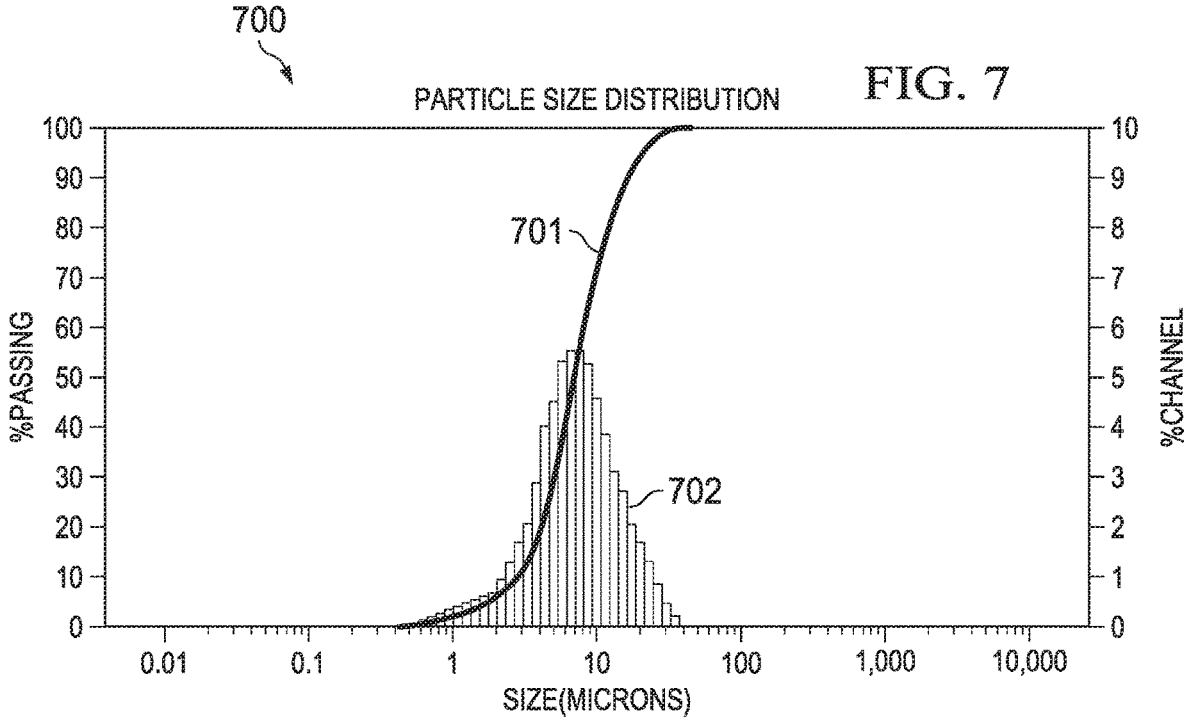
FIG. 7 is a graph of particle size distribution of a product processed using a set of shear plates of a preferred embodiment.

Referring to FIG. 7, graph 700 shows the results of a second test of the disclosed embodiments in a colloid mill processing an asphalt product. Graph 700 includes curve 701 and bar graph 702. Curve 701 illustrates the passing percentage of the particles. The volume percent-in-channel (% Chan) values are read as volume percent between the particle size on the same line and the line below. The passing percentage is the "passing grade" percent of particles that are acceptable/passable in the resulting product. Bar graph 702 is the channel percentage illustrating particle size distribution in the asphalt product in microns. The data for graph 700 is displayed in Tables 3, 4, 5, and 6 below.

TABLE 3

| Test 2 | | |
|---|---|---|
| Size (μm) | % Chan | % Pass |
| 2000 | 0.00 | 100.00 |
| 1826 | 0.00 | 100.00 |
| 1674 | 0.00 | 100.00 |
| 1535 | 0.00 | 100.00 |
| 1408 | 0.00 | 100.00 |
| 1291 | 0.00 | 100.00 |
| 1184 | 0.00 | 100.00 |
| 1086 | 0.00 | 100.00 |
| 995.6 | 0.00 | 100.00 |
| 913.0 | 0.00 | 100.00 |
| 837.2 | 0.00 | 100.00 |
| 767.7 | 0.00 | 100.00 |
| 704.0 | 0.00 | 100.00 |
| 645.6 | 0.00 | 100.00 |
| 592.0 | 0.00 | 100.00 |
| 542.9 | 0.00 | 100.00 |
| 497.8 | 0.00 | 100.00 |
| 456.5 | 0.00 | 100.00 |
| 418.6 | 0.00 | 100.00 |
| 383.9 | 0.00 | 100.00 |
| 352.0 | 0.00 | 100.00 |
| 322.8 | 0.00 | 100.00 |
| 296.0 | 0.00 | 100.00 |
| 271.4 | 0.00 | 100.00 |
| 248.9 | 0.00 | 100.00 |
| 228.2 | 0.00 | 100.00 |
| 209.3 | 0.00 | 100.00 |
| 191.9 | 0.00 | 100.00 |
| 176.0 | 0.00 | 100.00 |
| 161.4 | 0.00 | 100.00 |
| 148.0 | 0.00 | 100.00 |
| 135.7 | 0.00 | 100.00 |
| 124.5 | 0.00 | 100.00 |
| 114.1 | 0.00 | 100.00 |
| 104.7 | 0.00 | 100.00 |

TABLE 4

| Test 2 (continued) | | |
|---|---|---|
| Size (μm) | % Chan | % Pass |
| 95.97 | 0.00 | 100.00 |
| 88.00 | 0.00 | 100.00 |
| 80.70 | 0.00 | 100.00 |
| 74.00 | 0.00 | 100.00 |
| 67.86 | 0.00 | 100.00 |
| 62.23 | 0.00 | 100.00 |
| 57.06 | 0.00 | 100.00 |
| 52.33 | 0.00 | 100.00 |
| 47.98 | 0.00 | 100.00 |
| 44.00 | 0.00 | 100.00 |
| 40.35 | 0.00 | 100.00 |
| 37.00 | 0.15 | 100.00 |
| 33.93 | 0.29 | 99.85 |
| 31.11 | 0.44 | 99.56 |
| 28.53 | 0.63 | 99.12 |
| 26.16 | 0.87 | 98.49 |
| 23.99 | 1.14 | 97.62 |
| 22.00 | 1.42 | 96.48 |
| 20.17 | 1.71 | 95.06 |
| 18.50 | 2.02 | 93.35 |
| 16.96 | 2.35 | 91.33 |
| 15.56 | 2.69 | 88.98 |
| 14.27 | 3.05 | 86.29 |
| 13.08 | 3.42 | 83.24 |
| 12.00 | 3.81 | 79.82 |
| 11.00 | 4.19 | 76.01 |
| 10.09 | 4.58 | 71.82 |
| 9.25 | 4.96 | 67.24 |
| 8.48 | 5.24 | 62.28 |
| 7.78 | 5.43 | 57.04 |
| 7.13 | 5.53 | 51.61 |

TABLE 4-continued

| Test 2 (continued) | | |
|---|---|---|
| Size (μm) | % Chan | % Pass |
| 6.54 | 5.52 | 46.08 |
| 6.00 | 5.33 | 40.56 |
| 5.50 | 4.95 | 35.23 |
| 5.04 | 4.48 | 30.28 |

TABLE 5

| Test 2 (continued) | | |
|---|---|---|
| Size (μm) | % Chan | % Pass |
| 4.63 | 3.94 | 25.80 |
| 4.24 | 3.39 | 21.86 |
| 3.89 | 2.86 | 18.47 |
| 3.57 | 2.38 | 15.61 |
| 3.27 | 1.96 | 13.23 |
| 2.999 | 1.61 | 11.27 |
| 2.750 | 1.32 | 9.66 |
| 2.522 | 1.10 | 8.34 |
| 2.313 | 0.92 | 7.24 |
| 2.121 | 0.79 | 6.32 |
| 1.945 | 0.68 | 5.53 |
| 1.783 | 0.61 | 4.85 |
| 1.635 | 0.55 | 4.24 |
| 1.499 | 0.51 | 3.69 |
| 1.375 | 0.47 | 3.18 |
| 1.261 | 0.43 | 2.71 |
| 1.156 | 0.40 | 2.28 |
| 1.060 | 0.37 | 1.88 |
| 0.972 | 0.33 | 1.51 |
| 0.892 | 0.30 | 1.18 |
| 0.818 | 0.26 | 0.88 |
| 0.750 | 0.24 | 0.62 |
| 0.688 | 0.23 | 0.38 |
| 0.630 | 0.15 | 0.15 |
| 0.578 | 0.00 | 0.00 |
| 0.530 | 0.00 | 0.00 |
| 0.486 | 0.00 | 0.00 |
| 0.446 | 0.00 | 0.00 |
| 0.409 | 0.00 | 0.00 |
| 0.375 | 0.00 | 0.00 |
| 0.344 | 0.00 | 0.00 |
| 0.315 | 0.00 | 0.00 |
| 0.2890 | 0.00 | 0.00 |
| 0.2650 | 0.00 | 0.00 |
| 0.2430 | 0.00 | 0.00 |

TABLE 6

| Test 2 (continued) | | |
|---|---|---|
| Size (μm) | % Chan | % Pass |
| 0.2230 | 0.00 | 0.00 |
| 0.2040 | 0.00 | 0.00 |
| 0.1870 | 0.00 | 0.00 |
| 0.1720 | 0.00 | 0.00 |
| 0.1580 | 0.00 | 0.00 |
| 0.1450 | 0.00 | 0.00 |
| 0.1330 | 0.00 | 0.00 |
| 0.1220 | 0.00 | 0.00 |
| 0.1110 | 0.00 | 0.00 |
| 0.1020 | 0.00 | 0.00 |
| 0.0940 | 0.00 | 0.00 |
| 0.0860 | 0.00 | 0.00 |
| 0.0790 | 0.00 | 0.00 |
| 0.0720 | 0.00 | 0.00 |
| 0.0660 | 0.00 | 0.00 |
| 0.0610 | 0.00 | 0.00 |
| 0.0560 | 0.00 | 0.00 |
| 0.0510 | 0.00 | 0.00 |

TABLE 6-continued

| Test 2 (continued) | | |
|---|---|---|
| Size (μm) | % Chan | % Pass |
| 0.0470 | 0.00 | 0.00 |
| 0.0430 | 0.00 | 0.00 |
| 0.0390 | 0.00 | 0.00 |
| 0.0360 | 0.00 | 0.00 |
| 0.0330 | 0.00 | 0.00 |
| 0.0300 | 0.00 | 0.00 |
| 0.02790 | 0.00 | 0.00 |
| 0.02550 | 0.00 | 0.00 |
| 0.02340 | 0.00 | 0.00 |

Figure 8:
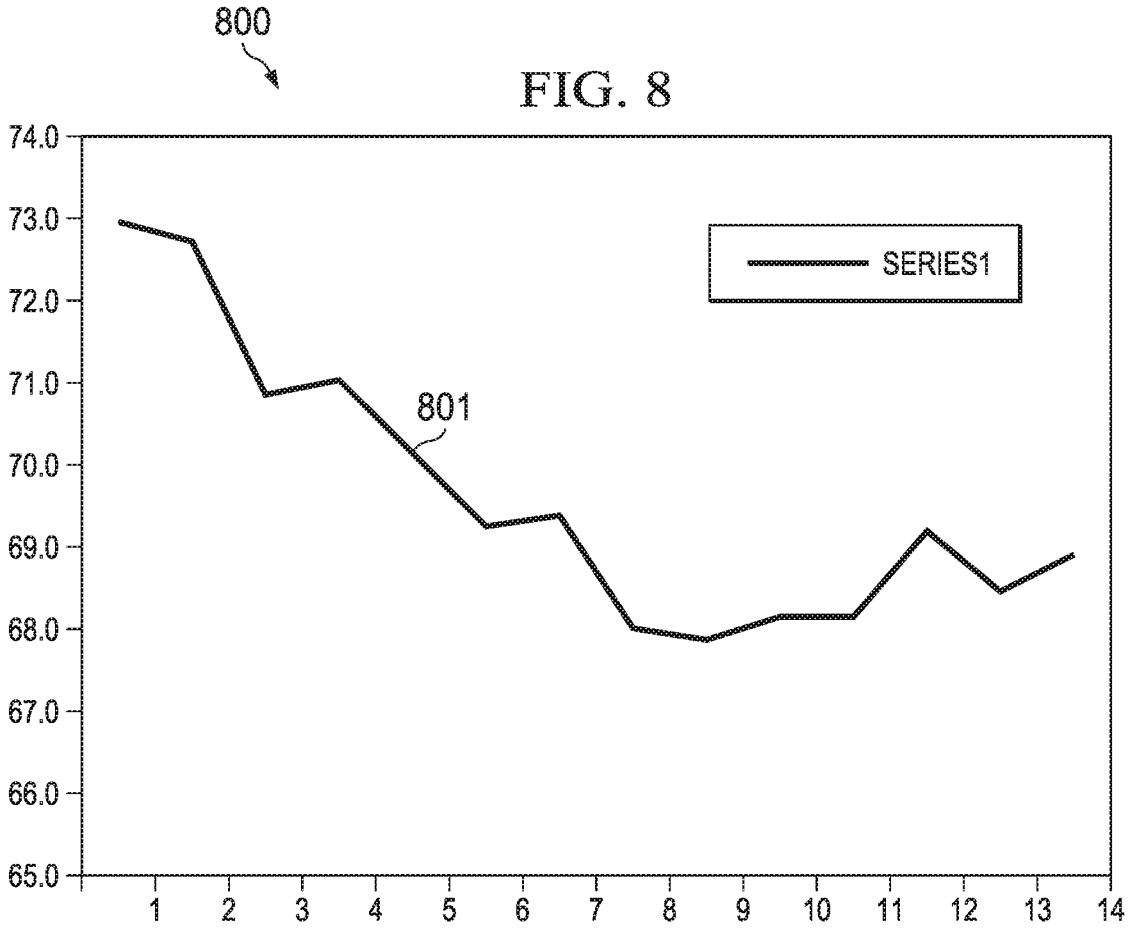
FIG. 8 is a graph of content savings percentage using a set of shear plates of a preferred embodiment.

Referring to FIG. 8, graph 800 includes curve 801. Curve 801 illustrates the reduction of the percentage of asphalt needed to obtain the same desired viscosity in the resulting product. Batches 1 through 7 illustrate the reduction percentage of a colloid mill utilizing a set of conventional shear plates. Batches 8 through 14 show a reduction percentage using the disclosed set of shear plates. As can be seen, beginning with batch 8, there is an approximately 1.4% in the percentage of asphalt savings.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A pair of shear plates for installation in a colloid mill, which adjacently supports the pair of shear plates in parallel alignment along a common axis of rotation, and imparts rotation therebetween, and which are useful for emulsifying a liquid mixture passing between the rotating pair of shear plates, the pair of shear plates comprising:

a rotor plate and a stator plate, each of which is planar, and circular about the axis of rotation, and each having a plurality of teeth disposed on first planar surfaces thereof, which first planar surfaces face each other in cooperative alignment when installed in the colloid mill, and wherein said pluralities of teeth are arranged in plural concentric rings of teeth, and wherein each of said plural concentric rings is positioned along a different radius from the axis of rotation, and wherein each of said plural rings comprise plural teeth that are separated by voids having planar circular bases therebetween, and wherein each of said plural teeth is configured with a pair of concentric sides that are correspondingly aligned along said plural concentric rings, and that are circular and parallel to one another about the axis of rotation, and each of said plural teeth is further configured with a pair of opposing sides that are located adjacent to two of said voids, and wherein intersections between said pair of concentric sides and said pair of opposing sides on each of said plural teeth define four curved cutting edges about each of said plural teeth.

2. The pair of shear plates of claim 1, and wherein:

said circular base portion joins said opposing sides of said plural teeth adjacent thereto, and transitions to concave surfaces upon each of said opposing sides.

3. The pair of shear plates of claim 1, and wherein said four curved cutting edges on said plural teeth are parabolic in shape.

4. The pair of shear plates of claim 1, and wherein:

said opposing sides are formed as concave surfaces.

5. The pair of shear plates of claim 1, and wherein:

said opposing sides formed as parabolic surfaces.

6. The pair of shear plates of claim 1, and wherein:

said plural teeth comprises surfaces defining a frustoconical shape.

7. The pair of shear plates of claim 1, and wherein:

each of said plural teeth along each of said plural rings is misaligned with respect to teeth on adjacent rings.

8. The pair of shear plates of claim 1, and wherein:

said voids between said plural teeth comprise circular base portion and said adjacent opposing sides of said plural teeth define a portion of a conic section, which increases in diameter from said base portion up said opposing sides of said adjacent teeth.

9. The pair of shear plates of claim 8, and wherein:

said voids between said plural teeth comprise circular base portion and said adjacent opposing sides of said plural teeth define a portion of a cylindrical section.

10. A method of emulsifying a liquid mixture using a rotor plate and a stator plate installed in a colloid mill, which adjacently supports the rotor plate and the stator plate in parallel alignment along a common axis of rotation, wherein the rotor plate and the stator plate are planar, and circular about the axis of rotation, each having a plurality of teeth disposed on first planar surfaces thereof, which first planar surfaces face each other in cooperative alignment, and wherein the pluralities of teeth are arranged in plural concentric rings of teeth, and wherein each of said plural rings is positioned along a different radius from the axis of rotation, and wherein each of the plural concentric rings comprise plural teeth that are separated by voids having planar circular bases, and wherein each of the plural teeth are configured with a pair of concentric sides that are correspondingly aligned along the plural concentric rings, and that are circular and parallel to one another about the axis of rotation, and each of the plural teeth is further configured with a pair of opposing sides that are located adjacent to two of the voids, and wherein intersections between the pair of concentric sides and the pair of opposing sides on each of the plural teeth define four curved cutting edges, the method comprising the steps of:

imparting a rotation between the rotor plate and stator plate;

passing a liquid mixture between the the rotor plate and stator plate;

emulsifying the liquid mixture passing between the rotating rotor plate and stator plate using cyclonic shearing forces created within the plural voids and a cutting action of the curved cutting edges.

11. The method of claim 10, and wherein the circular base portion joins the opposing sides of the teeth adjacent thereto, and transitions to concave surfaces upon each of the opposing sides, to thereby generate the cyclonic shearing forces.

12. The method of claim 10, and wherein the four curved cutting edges on the plural teeth are parabolic in shape.

13. The method of claim 10, and wherein the opposing sides are formed as concave surfaces, to thereby generate the cyclonic shearing forces.

14. The method of claim 10, and wherein the opposing sides formed as parabolic surfaces, to thereby generate the cyclonic shearing forces.

15. The method of claim 10, and wherein the plural teeth comprise surfaces defining a frustoconical shape.

16. The method of claim 10, and wherein each of the plural teeth along each of the plural rings is misaligned with respect to teeth on adjacent rings.

17. The method of claim 10, and wherein the voids between the plural teeth comprise circular base portion and the adjacent opposing sides of the plural teeth define a portion of a conic section, which increases in diameter from said base portion up said opposing sides of said adjacent teeth, to thereby generate the cyclonic shearing forces.

18. The method of claim 17, and wherein the voids between said plural teeth comprise circular base portion and the adjacent opposing sides of said plural teeth define a portion of a cylindrical section, to thereby generate the cyclonic shearing forces.

* * * * *